US006752488B2

(12) United States Patent
Scott

(10) Patent No.: US 6,752,488 B2
(45) Date of Patent: Jun. 22, 2004

(54) INKJET PRINT HEAD

(75) Inventor: Graeme Scott, Dublin (IR)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/170,008

(22) Filed: Jun. 10, 2002

(65) Prior Publication Data

US 2003/0227515 A1 Dec. 11, 2003

(51) Int. Cl.[7] ..... B41J 2/04
(52) U.S. Cl. ..... 347/54
(58) Field of Search ..... 347/46, 51, 54

(56) References Cited

U.S. PATENT DOCUMENTS

| | | | | | |
|---|---|---|---|---|---|
| 3,655,379 | A | * | 4/1972 | Gundlach | 347/51 |
| 4,480,259 | A | * | 10/1984 | Kruger et al. | 347/54 |
| 4,520,375 | A | * | 5/1985 | Kroll | 347/54 |
| 4,531,138 | A | * | 7/1985 | Endo et al. | 347/51 |
| 4,607,267 | A | * | 8/1986 | Yamamuro | 347/51 |
| 5,021,808 | A | * | 6/1991 | Kohyama | 347/51 |
| 5,121,141 | A | * | 6/1992 | Hadimoglu et al. | 347/46 |
| 5,568,170 | A | * | 10/1996 | Hirano et al. | 347/51 |
| 5,808,636 | A | * | 9/1998 | Stearns | 347/46 |
| 6,056,389 | A | * | 5/2000 | Moon et al. | 347/54 |
| 6,120,130 | A | * | 9/2000 | Hirano et al. | 347/46 |
| 6,474,783 | B1 | * | 11/2002 | Pilossof et al. | 347/51 |

FOREIGN PATENT DOCUMENTS

EP 1 008 451 6/2000

OTHER PUBLICATIONS

Kovacs, Micromachined Transducers Sourcebook, 1998, McGraw–Hill, pp. 719–722.*

G. Gorodetsky et al., "Calorimetric and acoustic study of ultraviolet laser ablation of polymers." *Appl. Phys. Lett.*, vol. 46, No. 9, pp 828–830 (May 1, 1985).

T. Masubuchi et al., "Nanometer–Nanosecond Oscillatory Expansion and Contraction Behavior of Polymer Films Induced by 248 nm Excimer Laser Excitation." *CHEMPHYSCHEM*, No. 3, pp 137–139 (2000).

X. Zhu et al., "Micromachined Acoustic–Wave Liquid Ejector." INTERNET:<http://www.ece.cmu.edu/~xzhu/publication/hilton.pdf>.

"Microlens is deposited directly onto laser–diode facet." Newsbreaks, *Laser Focus World*, (Dec. 2000). INTERNET:<http://lfw.pennnet.com/Article_Display.cfm-?Sectio n×Archives&Subsection×Dis . . . > (visited Sep. 30, 2002).

"Optical Devices." INTERNET:<http://www.emcore.com/html_documents/Mode.htm> (visited Apr. 26, 2002).

"Optoelectronics." INTERNET:<http://www.elm.chalmers.se/Research/Optoelectronics/default.htm.> (visited Apr. 26, 2002).

"Pattern Formation DOEs." INTERNET:<http:/www.phy-.hw.ac.uk/resrev/DOG/PatternFormationDOEs. html>. (visited Apr. 29, 2002).

* cited by examiner

*Primary Examiner*—Stephen D. Meier
*Assistant Examiner*—Blaise Mouttet

(57) ABSTRACT

An inkjet print head (10) includes one or more laser sources (12). Each laser source (12) is actuable to emit laser radiation and each laser source is associated with one or more ink chambers (18). Each ink chamber (18) includes a nozzle aperture (20) through which ink is dispensed and is arranged to, in use, communicate with an ink supply. Each chamber has a membrane (16) arranged to contact the ink in the ink chamber, the membrane being responsive to laser radiation from an associated laser source to produce an acoustic emission capable of displacing ink from the chamber.

18 Claims, 4 Drawing Sheets

INKJET PRINT HEAD

FIELD OF THE INVENTION

The present invention relates to an inkjet print head, a method of fabricating an inkjet print head, a print cartridge including such a print head and a printer arranged to operate such a print cartridge. Particularly, but not exclusively, the invention provides an inkjet print head which includes a laser source for generating acoustic waves which in turn produce a driving pressure for ink expulsion.

In the present specification, the term acoustic is used to describe a longitudinally propagating pressure wave through any of a solid, liquid or gas. In view of the operating frequency of print heads, this pressure wave may in fact have an ultrasonic frequency.

BACKGROUND OF THE INVENTION

Currently inkjet print head cartridges deliver ink using two basic mechanisms, thermal or piezoelectric. Thermal systems rely on rapid heating to generate bubbles in an ink firing chamber, which expand and expel ink. Piezoelectric systems rely on the flexing of a crystal to generate a pressure wave to drive ink out of an ink firing chamber.

Thermal systems are limited in resolution (minimum drop size) by the lack of control over the bubble generation process, and in delivery rate by the recovery/cooling cycle and time for ink to refill the void left by the bubble. The ink compositions must also be such as to withstand the thermal cycling of the system.

Piezoelectric devices are relatively expensive to build and limited in firing rate, typically in the order of MHz, by the response times of the material.

In both cases it is difficult to further miniaturize the systems. In particular, for piezo-crystals it is difficult to make them smaller whilst increasing their operating frequency and generating sufficient deflection to drive ink ejection.

At the same time, it is known that laser generated acoustic waves in solids can be produced by two mechanisms. In the thermoelastic regime, which occurs at low laser power densities, laser induced temperature rises produce rapid thermal expansion and transient acoustic waves. Such waves were detected early in the development of laser processing, see 'Calorimetric and acoustic study of ultraviolet laser ablation of polymers', G. Gorodetsky et al, Appl. Phys. Lett. Vol 46 (1985) pp 828-830. Laser generation of ultrasound in the thermoelastic regime is a nondestructive process. However, in the ablation regime, which occurs at high peak powers, the recoil forces generated by vaporized material leaving the sample generate strong acoustic waves or shock waves. This regime involves the removal of very thin layers of material, although this layer may be a renewable material such as an oil or liquid coating.

EP1008451A2, 'Laser-Initiated Ink-Jet Printing Method and Apparatus', filed Dec. 11, 1999 describes a laser driven ink jet printing head relying on the laser generation of acoustic waves. In this system, single or possibly multiple scanning laser beams are each focussed to generate respective acoustic waves in a liquid contained in a first chamber located above an ink-firing chamber. The acoustic waves are transmitted from the first chamber to the ink-firing chamber through an intermediate body which lies between the chambers and which is almost transparent to the acoustic waves. When the transmitted acoustic wave enters the ink-firing chamber, it causes a droplet of ink to be ejected from a nozzle lying in register with the focussed laser beam. However, in this system, the intermediate body must have sufficient thickness and strength to protect the ink chamber from the pressure perturbations generated by bubble formation and collapse etc in the first chamber, as well as being able to act as an acoustic window allowing acoustic waves to be transmitted to the firing chamber. These two requirements (acoustic window and protective barrier) limit the type and thickness of material that can be used for the intermediate body. These are major disadvantages to the cost and flexibility of a commercial inkjet printing system.

DISCLOSURE OF THE INVENTION

According to the present invention there is provided an inkjet print head as claimed in claim 1.

The present invention relies on laser produced pressure waves to generate a driving pressure for ink expulsion. In this sense it could offer the advantages of piezoelectric devices, in that the mechanism is independent of ink chemistry. However, laser devices can be operated at variable pulse repetition rates of up to GHz, overcoming the firing rate limitations of piezoelectric devices. The laser pulse energy is also infinitely variable, offering fine control over the driving pressure and droplet size.

Preferably the wall comprises a membrane. The prior art makes no reference to the provision within a print head of a laser cooperating with a membrane or to the permanent physical displacement of ink with the resultant pressure waves.

The present invention overcomes many of the problems of conventional inkjet mechanisms. In relation to firing rate limitations, it will be seen that in principle the firing rate of the print head can be increased to the pulsing rate of the laser source, currently GHz and increasing in the future.

By using acoustic emissions to directly expel the ink, rather than heat as in the prior art, the requirement of the ink chemistry to withstand rapid temperature cycling is mitigated, allowing a broader range of ink chemistries to be employed within inkjet print heads.

Because the laser sources used to generate the driving force for ink ejection are in general highly controllable, the print head provides more control over droplet size and speed.

Preferably, the laser sources are based on semiconductor technology and therefore readily miniaturized and integrated into electrical systems.

In principle the size of the laser generated acoustic source is limited by the focussability of the laser (around the wavelength of the laser light). In implementing the present invention, a smaller focussed spot or output beam could be an advantage, as for a given laser pulse energy this increases the energy density and this could generate more driving pressure for ink ejection.

This miniaturization means higher nozzle densities should be possible, thus increasing print head resolution.

The present invention differs from EP1008451 in the following respects:

1. The invention generates acoustic waves, preferably using a thermoelastic mechanism, in a solid material rather than an opto-acoustic effect in a liquid.

2. The invention generates the acoustic wave directly in a membrane. The superficially similar intermediate body in EP1008451 is an acoustic window and plays no part in the generation of the acoustic wave.

3. The membrane of the invention need not be made of an acoustically transparent material, if sufficiently thin. The intermediate body in EP100851 must be acoustically transparent and cannot be made arbitrarily thin as it also acts to protect the ink chamber from pressure perturbations associated with bubble generation in the buffer solution.

4. Since the membrane used in the current invention is a solid material, bubble formation does not result after deposition of the laser energy. Therefore, there is no disruption to further laser pulses, which might limit the firing rate of the system.

5. The current invention does not require an optical system to focus and distribute the laser beam as required for EP1008451. Neither does it use a buffer liquid. The print head is much simpler with fewer moving parts.

6. In a preferred embodiment of the invention, the laser sources are integrated into the print head and therefore there is no requirement to synchronize the movement of the laser, laser beam and print head mechanism to allow full page width coverage, again making the print head of the invention much simpler.

BRIEF DESCRIPTION OF THE DRAWINGS

Embodiments of the present invention will now be described, by way of example only, with reference to the accompanying drawings, in which.

DESCRIPTION OF THE PREFERRED EMBODIMENTS

Figure 1:
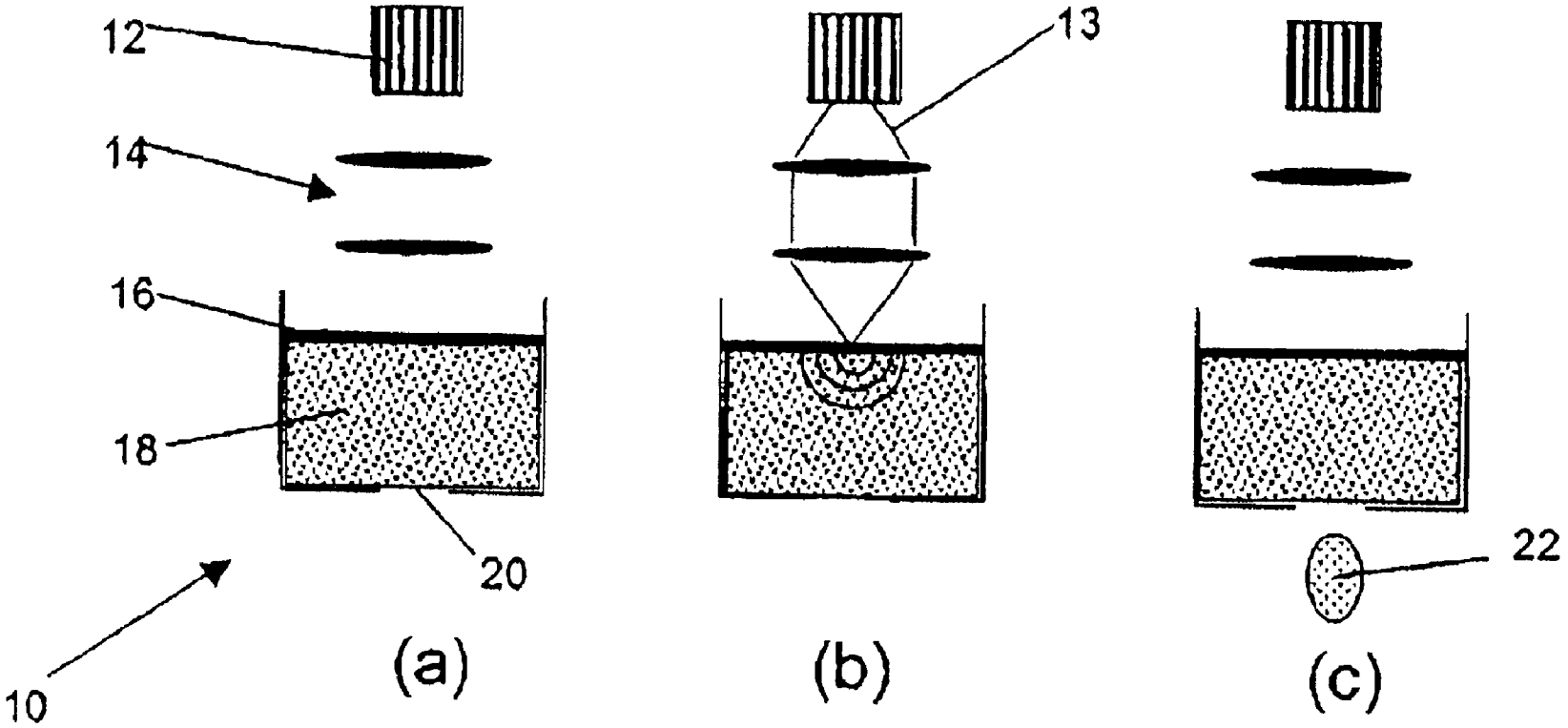
FIGS. 1(*a*) to 1(*c*) show in schematic form a firing sequence for a laser generated acoustic wave driven print head nozzle of one embodiment of the invention.

Referring now to FIG. 1 which shows one nozzle 10 for a laser generated acoustic wave driven inkjet print head according to a first embodiment of the present invention. Within the print head, the nozzle 10 is associated with a laser source 12, for example a semiconductor laser diode, which is switched by control circuitry (not shown) to selectively emit a laser beam 13 through a focussing lens system 14. If a semiconductor laser diode is selected as the laser source, then optical components may be directly attached to the output facet of the laser to aid miniaturization, see 'Microlens is deposited directly onto laser-diode facet', Newsbreaks, Laser Focus World, December 2000. Alternatively, graded index rods or micro-spheres may also be used as focussing elements.

Alternatively, in this embodiment, it will be seen that one laser source may be associated with more than one nozzle, with the focussing system being movable to shift the focus of the beam from one nozzle to another.

In any case, for any given nozzle, the beam is focussed on a membrane 16 which acts to close one side of an ink chamber 18 associated with the nozzle. A nozzle aperture 20 is defined in the ink chamber, which is also in fluid communication with an ink supply (not shown). FIG. 1(*a*) shows the system at rest, where the ink is contained within the chamber. In FIG. 1(*b*) a laser pulse is emitted and the laser beam focussed down onto the membrane 16. Either through the thermoelastic mechanism, or by ablation, a strong acoustic wave is generated in the thin membrane 16. It will be seen that a pressure pulse generated in the ablation regime, especially a shock wave, is likely to be stronger than that generated in the thermoelastic regime. The pressure pulse generated by thermal expansion and/or momentum transfer, propagates through the membrane and is transmitted into the ink, generating a pressure pulse in the ink chamber which in turn causes the ejection of an ink droplet 22, FIG. 1(*c*). The sequence shown in FIG. 1 is then repeated up to the maximum pulse rate of the laser, although the maximum firing rate is determined by the recovery time of the system to the pressure pulse.

Figure 2:
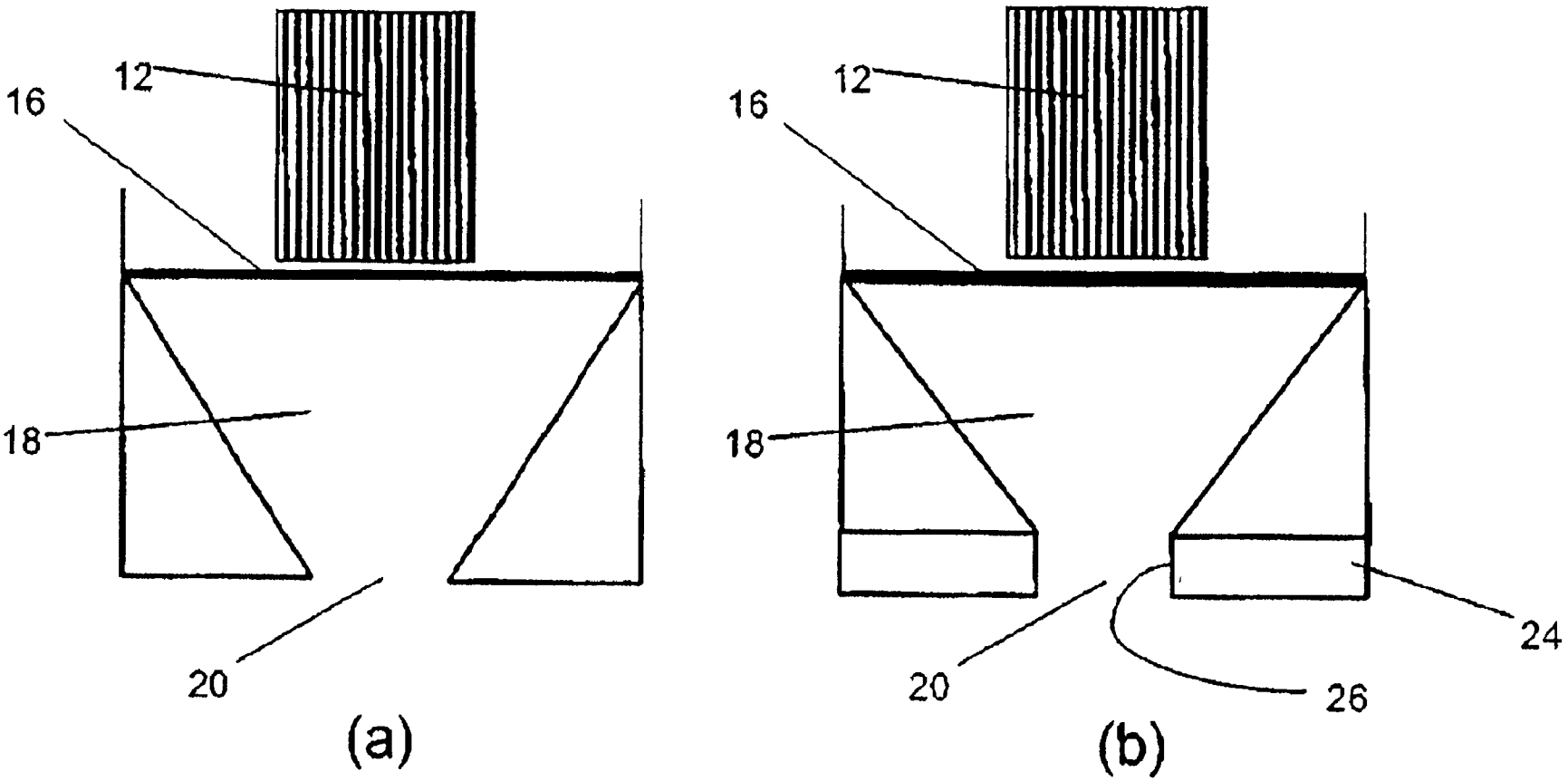
FIGS. 2(*a*) and 2(*b*) show in schematic form two variations a laser generated acoustic wave driven print head nozzle of a second embodiment of the invention.

In an alternative embodiment of the invention, FIG. 2, the laser source 12, is placed in very close proximity to the membrane 16. It is therefore possible to eliminate the need for focussing optics of the first embodiment entirely.

FIG. 2 also shows alternative ink chamber shapes for concentrating laser generated acoustic waves in the ink. In FIG. 2(*a*), the chamber 18 is defined by, for example, wet etching the layer of material which, once etched, forms the walls of the chamber. This provides a funnel type chamber narrowing towards the nozzle aperture 20. In FIG. 2(*b*) a further layer 24 is deposited over the chamber walls. In this case, the nozzle aperture defined in this layer is anisotropically etched to provide relative parallel side walls. These may prove less prone to wear than the acute edged walls of FIG. 2(*a*). In either case, these ink chamber shapes are intended to reflect and/or confine the laser generated acoustic wave, increasing the pressure generated in the ink chamber.

For either of the embodiments of FIGS. 1 and 2, the selection of the optimum membrane material and its thickness can be determined experimentally. However, some properties are clear. Material with a relatively high absorption coefficient and low thermal diffusivity will aid the conversion of laser to thermal/acoustic energy. The material should have a high ablation threshold at the selected laser wavelength to prevent excess erosion of the membrane. Finally a sandwich of materials, each with different properties may amplify the desired response to the laser pulse.

More particularly, polyimide (Kapton®) is an example of a suitable membrane material. Firstly, it is known that polyimide finds application as a radiating film for audio loudspeakers, which suggests that it may have a suitable lifetime for use in a print head. Furthermore, this material has been extensively studied with UV lasers and the ablation threshold found to be in the range 0.1-0.3 J/cm$^2$, see Gorodetsky et al. At these energy densities both acoustic emission and deflection have been detected in other polymers such as polymethylmethacrylate (Acrylic), see 'Nanometer-Nanosecond Oscillatory Expansion and Contraction Behaviour of Polymer films Induced by 248 nm Excimer Laser Excitation', T. Masubuchi et al., ChemPhysChem Vol 3 (2000) pp 137-139 (see appendix A), which is incorporated herein by reference, and these too may be useful as membrane materials.

It is clear that to provide a practical laser driven print head, the laser source itself should be miniaturized preferably to have dimensions of the order of approx. 100 $\mu$m.

Furthermore, the laser would need to be selected for maximum peak power and for the desired pulsing rate for application in a print head, regardless of the operating wavelength. As mentioned more generally above, one potential laser source is a pulsed semiconductor laser diode chip.

There are numerous pulsed laser diodes on the market and the characteristics of the two are given below, by way of example:

| Make & Model | Wavelength (nm) | Peak Power (W) | Pulse Length (nsec) | Emitting Area ($\mu$m × $\mu$m) | Energy Density (J/cm2) |
|---|---|---|---|---|---|
| Laser Diode Inc. CVD 60 | 905 | 4 | 50 | 3000 × 80 | 0.083 |
| Hamamatsu L5758 | 860 | 23 | 100 | 300 × 1 | 0.766 |

Note:
The energy density of the emitted beams above is determined by assuming the emitting area is rectangular.

If the lasers are placed sufficiently close to the target, especially as in the case of the embodiment of FIG. 2, it can be assumed that the achievable energy density on the target is the same as the above values. If polyimide were used as a membrane material, with an ablation threshold in the range 0.1-0.3 J/cm2, the above two lasers would be capable of generating acoustic emission from the membrane. As such, these figures show that sufficient laser energy density is available at the output facet of the laser diode to generate acoustic waves.

However, currently individual laser diode chips are packaged with circuitry etc to form packages of 5-10 mm size and these would probably be too large for practical use.

A more ideal semiconductor laser type for the print-head application would be a vertical cavity surface-emitting laser (VCSEL), such as those manufactured by EMCORE, New Jersey, see "Optical Devices," which is incorporated herein by reference and which appears as appendix B to this application. These are produced as semiconductor diode arrays, currently to a maximum of 12 on a 3.2×0.4 mm die and as such have dimensions of the order required to produce a practical print head.

In a third embodiment of the invention, FIGS. 3 to 6, such laser diode structures 30 are incorporated within an integrated print head chip fabricated within a die of an array of such print heads on a silicon wafer substrate 32. This provides a print head containing the drive circuitry, identification circuitry etc. necessary to form a high-resolution print head with a closely spaced 2-dimensional array of nozzles. This integration is analogous to the manner in which existing thermal inkjet print heads including resistive heaters are produced. As in this case, the head is then incorporated into a print cartridge in a conventional manner with connections to the print cartridge circuitry being made through wire bonds. The print cartridge circuitry is then in turn connected to printer control circuitry, which in accordance with an image mask selectively fires individual lasers 30 to deposit ink onto a print medium.

Figure 3:
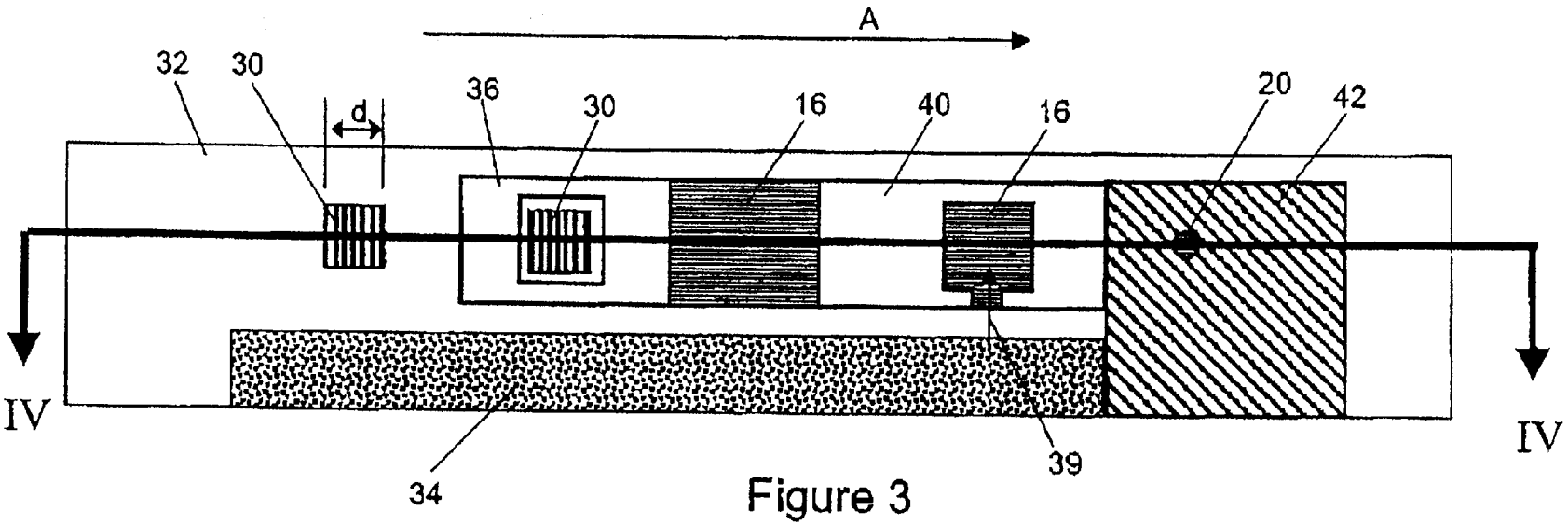
FIG. 3 shows a manufacturing sequence for production of one half of a laser generated acoustic wave print head die of a third embodiment of the invention.
Figure 4:
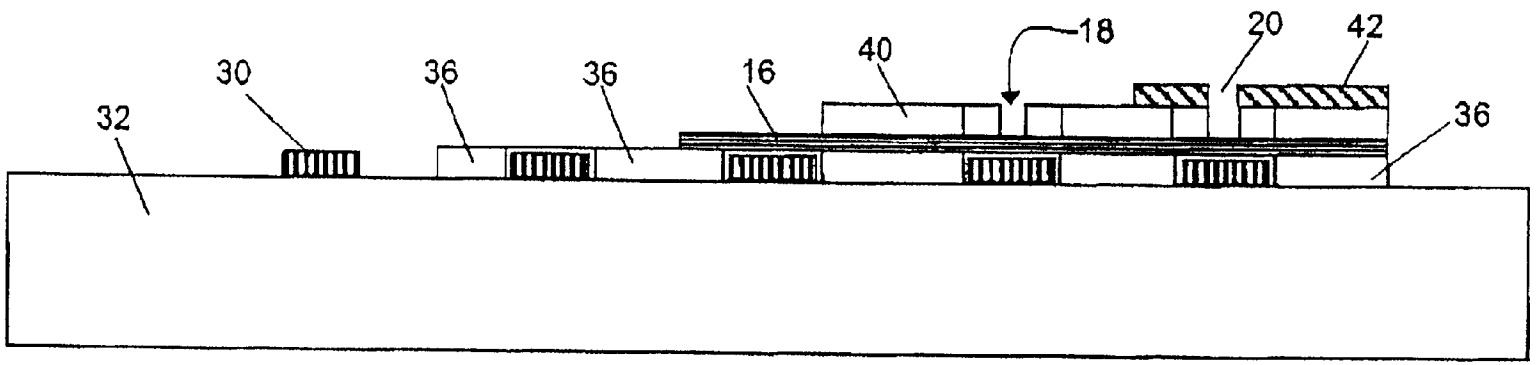
FIG. 4 is a cross-sectional view of the sequence of FIG. 3 viewed along the line IV-IV.

Referring now to FIGS. 3 and 4, which show a manufacturing sequence running in the direction of the arrow A for producing the print head of the third embodiment. Only the top half of the print head is shown, with the remainder being a mirror image of the top half centered about a common ink feed slot 34 cut through the wafer 32. (In a colour print head this two row array of nozzles with a common ink feed slot would be reproduced for each colour to be dispensed by the print head.)

The process begins by fabricating a plurality of Vertical Cavity Surface Emitting Laser (VCSEL) diodes 30 directly on the silicon wafer substrate 32. In the present embodiment, each VCSEL diode is 30×30 $\mu$m in size indicated by the numeral d.

A polymer barrier layer 36 defined by conventional photolithographic and etch steps is then deposited around the VCSEL diodes to planarize the substrate. As explained below, the layer 36 is preferably deeper than the VCSELs to define a cavity in the region of the VCSEL. Furthermore, the layer 36 need not actually contact the sides of the VCSEL so providing for heat dissipation.

Following this step a polyimide membrane layer 16, corresponding to the membrane of the first two embodiments, is deposited and patterned as necessary as it need only extend over the openings in the layer 36 in which the VCSELs are located. As in the second embodiment, this layer covers the field of view of each VCSEL disposed beneath the layer 16 and lies close enough to the laser source so as not to require focusing optics between the laser source and the layer. If the layer 16 is in intimate contact with the VCSEL, then there may be some burning during operation of the device. For this reason, in a preferred embodiment, the layer 16 is spaced slightly from the emitting surface of the VCSEL. This can be achieved using a number of different fabrication techniques. For example, the polyimide could be provided in tape form and rolled over the surface of the wafer after the layer 36 has been formed. As long as the layer 36 is slightly deeper than the VCSELs and air gap will be formed within the VCSEL cavity. The tape layer can then be patterned and etched as required.

Alternatively, the VCSEL cavity could be filled with a temporary soluble filler such as a wax. The polyimide could be provided in liquid form and spun over the surface of the wafer and cured. The VCSEL cavity would then need to be suitably shaped to allow the filler to be dissolved in the region of the VCSEL. It may also be possible to do without the filler and simply shape the VCSEL cavity to allow the polyimide layer to be etched back from around the VCSEL.

In any case, once the membrane 16 has been laid down, a further polymer barrier layer 40 is then deposited on the membrane layer and patterned to form the walls of respective ink chambers 18 corresponding to each VCSEL. As in a conventional ink jet print head, each ink chamber 18 is in fluid communication (as indicated by the numeral 39) with an ink feed slot which passes through the substrate 32 to supply ink from a reservoir (not shown) within the body of the cartridge through to the nozzles. Again, in a colour print head, it will be seen that different groups of nozzles will communicate with respective ink feed slots for different colours, however, this does not affect the description or implementation of the present invention.

Finally, a metallic or polymer orifice plate 42 with predrilled holes corresponding to the nozzle apertures 18 is applied to the layer 40. It is this surface through which, in use, ink will be ejected from the print head as a result of the acoustic wave generated by the VCSELs within the print head.

Figure 5:
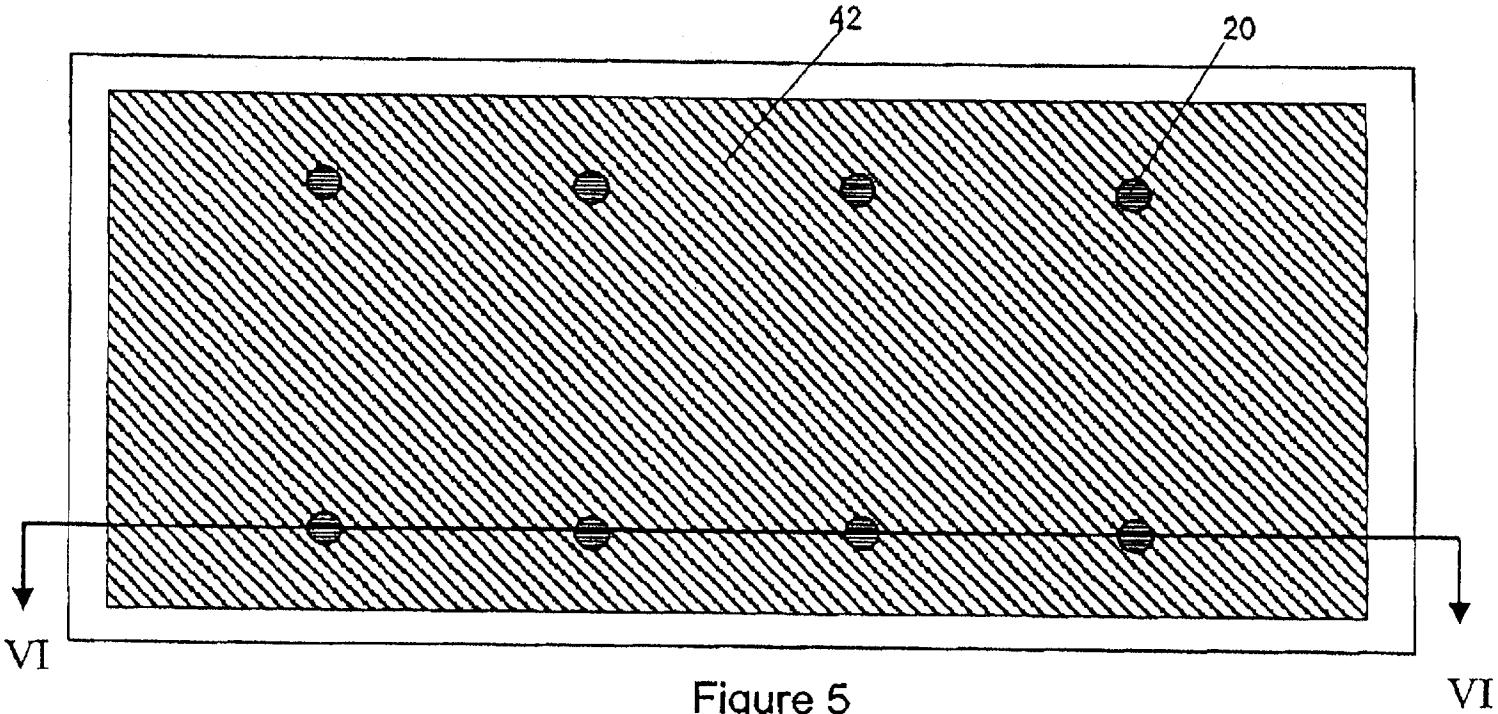
FIG. 5 is schematic view of a portion of a laser generated acoustic wave driven inkjet print head die produced according to the sequence of FIGS. 3 and 4.
Figure 6:
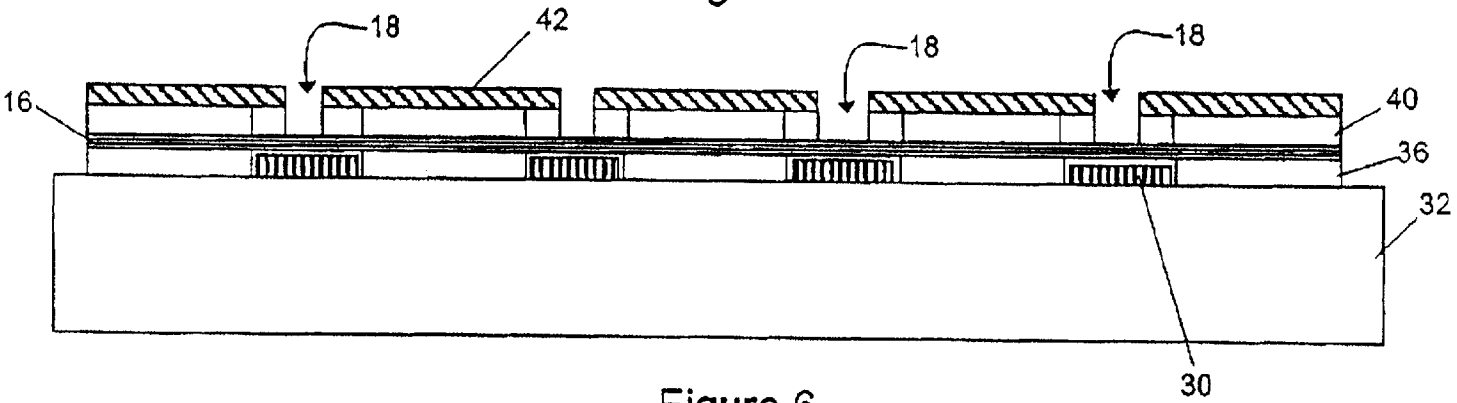
FIG. 6 is a cross-sectional view of the print head die of FIG. 5 viewed along the line VI-VI.

Referring now to FIGS. 5 and 6 which show a portion comprising 8 chambers of a complete print head fabricated as shown in FIGS. 3 and 4. The ink feed slot while not shown lies behind the orifice plate 42 between the two rows of nozzle apertures 20. It will also be seen that it is the membrane 16 which is visible within an empty ink chamber.

Finally, it is acknowledged that FIGS. 3 to 6 are shown for exemplary purposes only. It is clear that further circuitry needs to be incorporated in a commercial print head including but not limited to: conductive traces connecting each VCSEL to power, ground and signal supplies; identification circuitry to enable printer control circuitry to identify and operate the print cartridge including the print head correctly; temperature measurement circuitry etc.

It will be seen that variations of the above embodiments are possible. For example, there is an opportunity to use the properties of a coherent laser source to provide a pattern of focussed light on the membrane and so form acoustic sources of different patterns. This approach is possible particularly where the laser beam is very strongly absorbed in the membrane and as such the resultant acoustic waves are effectively generated from a surface source i.e. optical absorption depth<<wavelength of acoustic wave, rather than a volume source. The acoustic waves will therefore have a high degree of coherence.

The most general form of this technique would be to use diffractive optical elements (DOE), to shape the laser beam, see the document entitled 'Pattern Formation DOEs' by the Diffractive Optics Group, Heriot-Watt University, a copy of which document appears as appendix C to this application. This document is incorporated herein by reference. This would allow almost any light pattern to be generated on the membrane, offering considerable scope in the acoustic source shapes available. One known technique is to use a series of concentric rings to generate focussed acoustic waves through constructive interference (see 'Micromachined Acoustic-wave Liquid Ejector', by X. Zhu et al., a copy of which is appended hereto as appendix D and which is incorporated herein by reference), in effect forming the acoustic equivalent of an optical Fresnel lens. As with conventional optical elements, it has been shown to be possible to integrate DOEs directly onto semiconductor laser structures, see "Optoelectronics" published by Chalmers University of Technology, a copy of which is appended hereto as appendix E and which is incorporated herein by reference.

An alternative miniature laser source could be a fibre laser, or a higher power laser source fed to a fibre bundle, which is then split to drive multiple firing chambers.

What is claimed is:

1. An inkjet print head comprising one or more laser sources, each laser source being actuable to emit laser radiation and each laser source being associated with one or more ink chambers, each ink chamber including a nozzle aperture through which ink is dispensed and being arranged to, in use, communicate with an ink supply, each chamber having a membrane arranged to contact the ink in the ink chamber, said membrane being responsive to laser radiation from an associated laser source to produce an acoustic emission capable of displacing ink from said chamber.

2. An inkjet print head as claimed in claim 1 wherein said laser source emits radiation at a first energy density and said radiation is incident on said membrane at a second energy density less than said first energy density, said second energy density being sufficient to produce an acoustic emission from said membrane.

3. An inkjet print head as claimed in claim 2 where said membrane comprises a material having an ablative threshold above said second energy density.

4. An inkjet print head as claimed in claim 2 wherein said second energy density causes thermoelastic deformation of said membrane.

5. An inkjet print head as claimed in claim 1 wherein the membrane has a thickness in the range of 1–5 $\mu$m.

6. An inkjet print head as claimed in claim 1 wherein the membrane comprises one of a homogeneous material or a composite material.

7. An inkjet print head as claimed in claim 1 wherein said membrane comprises a polymeric material.

8. An inkjet print head as claimed in claim 7 wherein said membrane comprises one of polyimide or polymethylmethacrylate.

9. An inkjet print head as claimed in claim 1 wherein said one or more laser sources comprises one or more of a pulsed semiconductor laser diode, a fibre laser or a laser and a fibre bundle.

10. An inkjet print head as claimed in claim 1 comprising a substrate on which said one or more laser sources are formed, on top of which said membranes are located and on top of which said ink chambers are defined, said ink chambers being in fluid communication with an associated ink feed slot.

11. An inkjet print head as claimed in claim 10 wherein said substrate comprises a silicon die and wherein said one or more laser sources comprises an integral vertical cavity surface-emitting laser.

12. An inkjet print head as claimed in claim 10 further comprising an orifice plate comprising one or more apertures spaced apart so that when located on said print head, said apertures lie in register with respective ink chamber nozzle apertures.

13. An inkjet print head as claimed in claim 1 further comprising focussing optics disposed between said one or more laser sources and an associated ink chamber membrane.

14. A print cartridge comprising a cartridge body incorporating a print head as claimed in claim 13 and one or more ink reservoirs in fluid communication with respective ink feed slots, said print head including circuitry connecting said one or more laser sources to electrical contacts on said cartridge body.

15. A printer including a print cartridge as claimed in claim 14 and printer control circuitry operable to control the print cartridge.

16. A method of fabricating an inkjet print head comprising:

providing one or more laser sources, each laser source being actuable to emit laser radiation;

providing one or more ink chambers, each ink chamber being associated with a laser source;

providing in each ink chamber a nozzle aperture through which, in use, ink is dispensed;

providing a communication path between each ink chamber and an ink supply; and providing in each chamber a membrane arranged to contact the ink in the ink chamber, said membrane being responsive to laser radiation from an associated laser source to produce an acoustic emission capable of displacing ink from said chamber.

17. A method of operating of a printer, said printer including an inkjet print head comprising one or more laser sources, each laser source being associated with one or more ink chambers, each ink chamber being arranged to, in use, communicate with an ink supply and including a nozzle aperture through which ink is dispensed and a membrane arranged to contact ink in the ink chamber, the method comprising:

selectively actuating each laser source to emit sufficient laser radiation towards a membrane of an ink chamber to that said laser radiation produces an acoustic emission capable of displacing ink from said chamber.

18. An inkjet print head comprising one or more laser sources, each laser source being actuable to emit laser radiation and each laser source being associated with one or more ink chambers, each ink chamber including a nozzle aperture through which ink is dispensed and being arranged to, in use, communicate with an ink supply, each chamber further including a membrane disposed between said chamber and an associated laser source, said membrane being responsive to laser radiation from an associated laser source to produce an acoustic emission capable of displacing ink from said chamber.

* * * * *

UNITED STATES PATENT AND TRADEMARK OFFICE

CERTIFICATE OF CORRECTION

PATENT NO. : 6,752,488 B2
DATED : June 22, 2004
INVENTOR(S) : Graeme Scott

It is certified that error appears in the above-identified patent and that said Letters Patent is hereby corrected as shown below:

Title page,
Item [75], Inventor, change "Graeme Scott, Dublin (IR)" to -- Graeme Scott, Maynooth (IR) --.

Column 7,
Line 64, change "range of 1-5$\mu$m" to -- range of 1-50 $\mu$m --.

Column 8,
Line 63, change "to that" to -- so that --.

Signed and Sealed this

Sixth Day of September, 2005

JON W. DUDAS
*Director of the United States Patent and Trademark Office*